United States Patent [19]

Shaw et al.

[11] 4,273,823

[45] Jun. 16, 1981

[54] GEAR CRIMPED POLYESTER YARNS

[75] Inventors: Frederick W. Shaw; William E. Whale, both of Harrogate, England

[73] Assignee: Imperial Chemical Industries Limited, London, England

[21] Appl. No.: 82,924

[22] Filed: Oct. 9, 1979

[30] Foreign Application Priority Data

Oct. 27, 1978 [GB] United Kingdom ..... 42271/78

[51] Int. Cl.[3] ..... D03D 3/08; D02G 3/00

[52] U.S. Cl. ..... 428/224; 28/279; 428/253; 428/365; 428/369; 428/397

[58] Field of Search ..... 428/224, 365, 369, 397, 428/253; 28/279

[56] References Cited

U.S. PATENT DOCUMENTS 3,293,843 12/1966 Bilby et al. ..... 28/279

FOREIGN PATENT DOCUMENTS 984922 1/1964 United Kingdom .
1127005 9/1968 United Kingdom .
1255478 12/1971 United Kingdom .
1371951 10/1974 United Kingdom .
1510171 5/1978 United Kingdom .
1552595 9/1979 United Kingdom .

*Primary Examiner*—James J. Bell
*Attorney, Agent, or Firm*—Cushman, Darby & Cushman

[57] ABSTRACT

A drawn gear-crimped polyester yarn with latent bulk is provided, the amount and nature of the bulk being such that the yarn has an initial crimp as defined of at least 1.5%, preferably of above 2%, and a mechanical crimp stability as defined of above 0%. The crimped polyester yarn may be produced by heating a drawable polyester yarn having a birefringence in the range $32\times10^{-3}$ to $125\times10^{-3}$ inclusive, preferably $35\times10^{-3}$ to $125\times10^{-3}$ inclusive, crimping the yarn by guiding it between the intermeshing teeth of a set of toothed wheels such that the yarn is caused to follow a sharply zig-zag path, the toothed wheels being rotated at a sufficient speed such that the yarn is drawn by the tension so imparted to the yarn by the toothed wheels and subsequently forwarding the crimped yarn from the teethed wheels under a controlled tension within the range 0.15 to 0.50 g per decitex inclusive, based on the decitex of the drawn polyester yarn.

7 Claims, 1 Drawing Figure

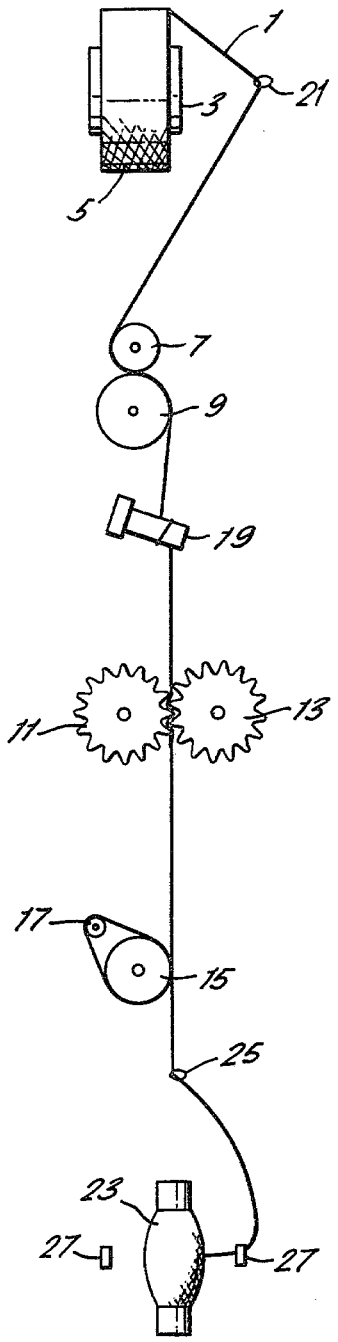
1
21
3
5
7
9
19
11
13
17
15
25
23
27
27

GEAR CRIMPED POLYESTER YARNS

The present invention concerns improvements in or relating to the production of gear crimped polyester yarns.

Gear crimping of synthetic yarns is well known in the art. A process for drawing and gear crimping an undrawn synthetic yarn is described in British Patent Specification No. 984,922. The use of undrawn polyamide and polyester yarns is described. Gear crimping of drawn synthetic yarns is also known. Despite the existance of extensive prior art, the commercial production of a gear crimped polyester yarn has not proved practicable. The use of undrawn polyester yarn in a draw-gear crimping process is unsatisfactory because of extremely low bulk and breaking of filaments in the process. The use of drawn polyester yarn in a gear crimping process is unsatisfactory because of unacceptably low bulk. The low bulk achieved hitherto is particularly apparent in finished fabric made from the crimped yarn.

It has now been found possible to produce a drawn gear crimped polyester yarn having a useful bulk which is higher than that produced by known gear-crimping processes. Compared with conventional false twist crimped yarns, the bulk of the gear-crimped yarns according to the present invention is low; however, the amount and nature of the bulk make the present yarns extremely suitable for the production of fabrics having desirable aesthetics. Further, it is difficult to achieve bulked yarns with this lower amount of bulk using conventional false twist crimping machines.

According to the present invention, there is provided a drawn gear-crimped polyester yarn with latent bulk characterised by an initial crimp as defined herein of at least 1.5%, preferably of above 2%, and a mechanical crimp stability as defined herein of above 0%.

Preferably, the drawn gear crimped polyester yarn has an initial crimp above 3% and a mechanical crimp stability of above 35%.

According to the present invention, there is further provided a continuous process for producing a synthetic yarn with latent bulk comprising the steps of heating a drawable yarn, crimping the yarn by guiding it between the inter-meshing teeth of a set of toothed wheels such that the yarn is caused to follow a sharply zig zag path, the toothed wheels being rotated at a sufficient speed such that the yarn is drawn by the tension so imparted to the yarn by the toothed wheels and subsequently forwarding the crimped yarn from the toothed wheels under a controlled tension characterized in that the drawable yarn is a polyester yarn having a birefringence in the range $32\times10^{-3}$ to $125\times10^{-3}$ inclusive, preferably $35\times10^{-3}$ to $125\times10^{-3}$ inclusive, and the crimped polyester yarn is forwarded from the toothed wheels under a controlled tension within the range 0.15 to 0.50 g per decitex inclusive, based on the decitex of the drawn polyester yarn.

Initial crimp (EK) and mechanical crimp stability (KB) are defined as follows:

The gear crimped polyester yarn with latent bulk is wound at a tension of 1.0 centi-newtons (cN) per tex to form a skein of 1 meter circumference and total decitex of 2500. Thus, for example, 16 wraps are required for a yarn having a decitex of 76. The skein is hung and preloaded with a load of 0.01 cN per tex. The preloaded skein is heated at 120° C. for 10 minutes to develop the bulk and is then cooled. The skein is subjected to a force of 1 cN per tex for 10 seconds and its length (Lo) is measured. After an interval of 10 minutes, the length of the skein is remeasured ($L_1$) supporting the pre-load of 0.01 cN per tex. After an interval of 10 minutes, a force of 0.1 cN per tex is applied for 10 seconds and immediately afterwards a high force of 10 cN per tex is applied for 10 seconds. After 20 minutes the length of the skein is measured (L3) under the pre-load of 0.01 cN per tex.

$$\text{Initial crimp } (EK) = \frac{Lo - L_1}{Lo} \times 100\%$$

$$\text{Mechanical crimp stability } (KB) = \frac{Lo - L3}{Lo - L_1} \times 100\%$$

Initial crimp and mechanical crimp stability values used herein are the mean of EK and KB measurements, respectively, on at least 5 skeins of yarn.

The above procedure is similar to that described in the German standard DIN 53840 and is conveniently carried out on a Texturmat machine manufactured by Herbert Stein, Munchengladbach, W. Germany.

Initial crimp (EK) is a measure of the percentage reduction in length from the straightened length of a bulked yarn as the result of the bulked structure. Mechanical crimp stability (KB) is a measure of the proportion of bulk remaining after release of a specified high load.

Drawn gear-crimped polyester yarns having an initial crimp of at least 1.5% and a mechanical crimp stability of above 0% possess a level of bulk which is commercially acceptable and the bulk is sufficiently stable to tension. The advantages of such yarns are particularly apparent in finished fabrics in which the bulk has been developed.

The term yarn as used herein means a monofilament yarn or a multifilament yarn. In the case of a multifilament yarn, the decitex of the drawn yarn is preferably less than 400.

The term polyester as used herein means a polyester or a copolyester. The polyester yarn may contain additives such as antioxidants, stabilisers, antistatic agents, delustrants or colouring materials.

The drawable polyester yarn to be used in the present process may have been intermingled during its manufacture.

The filament or filaments of the polyester yarn may have a filament cross-section which is circular or non-circular, for example, trilobal.

Most preferably, there is used in the process according to the invention a drawable polyester yarn having a birefringence in the range $40\times10^{-3}$ to $120\times10^{-3}$.

The crimped polyester yarn is forwarded from the toothed wheels under a preferred tension in the range 0.20 to 0.40 g per decitex based on the decitex of the drawn polyester yarn. Forwarding the crimped polyester yarn from the toothed wheels under a low tension of less than 0.15 g per decitex leads to problems of filamentation and yarn breaking and the yarn tends to lick back around the toothed wheels. The use of a high tension of above 0.50 g per decitex produces a yarn having poor mechanical properties and a bulk which appears to be due predominently to edge crimping. Such bulk produced from edge crimping does not yield useful bulk in fabrics made from the yarns. The amount of bulk due to true gear crimping, measured by EK, is low and its stability is poor.

The drawable polyester yarn may be heated by contact with a heated plate or a heated circular pin or by passage through a tube supplied with a heated fluid such as hot air or superheated steam. The drawable yarn is preferably heated by contact with a heater at a temperature of at least 150° C.

The set of toothed wheels may comprise two or three gear wheels one of which is driven and drives the other wheel or wheels. Preferably, the teeth are involute in shape. Preferably, the gear wheels have an integral step structure as described in British Patent Specification No. 1,255,478. Tension sufficient to draw the yarn is exerted by passage of the yarn over the tips of the intermeshing teeth of the rotating gear wheels.

In British Patent specification No. 984,922, the amount of bulk in the gear-crimped yarns disclosed therein is measured by a well-known skein length test in which a skein of yarn is made by winding on a wrap wheel. The skein is then suspended in water at 60° C. and the skein length is measured under a given load. We have found that, for the gear-crimped polyester yarns according to the present invention, this skein length test does not correlate with the bulk shown in fabrics made from the polyester yarns. We have found a good correlation between bulk shown in fabrics and initial crimp and mechanical crimp stability values measured as described herein on the polyester yarns.

BRIEF DESCRIPTION OF THE DRAWING

An embodiment of the invention will now be described by way of example with reference to the accompanying FIGURE which is a diagrammatic representation of a process according to the invention.

A drawable polyester multifilament yarn 1 having a birefringence in the range $32\times10^{-3}$ to $125\times10^{-3}$ is withdrawn over one end of cylinder 3 from a package 5 of wound yarn. Withdrawal is effected via a pigtail guide 21 by rotation of feed roll 9 and nip roll 7, the yarn being passed around nip roll 7 a sufficient number of times to avoid slippage of the yarn.

Downstream of the feed roll 9 and nip roll 7 there are located intermeshing gear wheels 11, 13 and a yarn tensioning roll 15 with its associated separator roll 17. The gear wheel 13 is driven by driving gear wheel 11. A single passage of the yarn between the intermeshing teeth of the gear wheels 11 and 13 induces crimp in the yarn by causing it to follow a sharply zig-zag path. Between the feed roll 9 and the gear wheels 11, 13 the yarn is passed once around an electrically heated metal pin 19. The gear wheels 11, 13, are rotated at a sufficient speed compared to the feed roll 9 such that the polyester yarn is drawn by the tension exerted on it, the location of the draw point being on the heated pin 19. The crimped drawn yarn is withdrawn by tensioning roll 15 from gear wheels 11, 13 under a controlled tension within the range 0.15 to 0.50 g per decitex based on the decitex of the drawn yarn. The yarn is passed sufficient times around tensioning roll 15 and separator roll 17 to avoid slippage of the yarn.

On leaving the tensioning roll 15, the yarn is wound on a ring spindle package 23 twist being inserted in the yarn below balloon-guide 25 by rotation of the spindle and rotation of a traveller (not shown) around ring 27.

The yarn so produced is a drawn polyester yarn having latent bulk. The bulk may be developed by subjecting the yarn in yarn or fabric form, to a thermal treatment.

The following examples illustrate but do not limit the present invention.

EXAMPLE 1

A 116 decitex 22 filament poly(ethylene terephthalate) yarn having a birefringence of $47.9\times10^{-3}$ and a trilobal filament cross-section was drawn and crimped by a process as shown diagrammatically in the accompanying drawing. The heated metal pin was circular having a diameter of 2.22 cm and a temperature of 160° C. The gear wheels were made of stainless steel and had 38 teeth per inch. The intermeshing of the gear wheels was such that the maximum overlap of teeth on the two gears was 0.356 mm.

The speed of the gear wheels was adjusted such that the yarn was drawn by the tension imparted to the yarn between the heated pin and the gear wheels. The surface speed of the tensioning roll was 540 meters per minute and the ratio of the surface speed of the tensioning roll to the surface speed of the feed roll was 1.66. The yarn tension between the gear wheels and the tensioning roll was controlled at 25 g.

The yarn so produced had a decitex of 71 and possessed latent bulk. The yarn had an initial crimp (EK) and a mechanical crimp stability (KB) as shown in Table 1.

EXAMPLES 2–4

Three gear-crimped poly(ethylene terephthalate) yarns were produced as in Example 1 except that the process conditions shown in Table 1 were used. The properties of the yarns so produced are shown in Table 1.

COMPARATIVE EXAMPLES A AND B

Two gear crimped poly(ethylene terephthalate) yarns were produced from a drawable feed yarn having a birefringence of $31.2\times10^{-3}$ and a drawn feed yarn having a birefringence of $140\times10^{-3}$. The process conditions were as in Example 1 except for those shown in Table 1.

The properties of the yarns so produced are shown in Table 1.

The use of undrawn yarn of birefringence $11\times10^{-3}$ was not practicable as a process due to breaking of filaments in the yarn.

TABLE 1

| EXAMPLE | FEED YARN BIREFRINGENCE X10³ | FEED YARN DECITEX | RATIO OF TENSIONING ROLL TO FEED ROLL SPEED | DECITEX OF YARN PRODUCED | EK (%) | KB (%) |
|---|---|---|---|---|---|---|
| Comparative A | 31.2 | 147 | 1.90 | 78 | 1.9 | −2.2 |
| 1 | 47.9 | 116 | 1.66 | 71 | 2.3 | 4.6 |
| 2 | 78.1 | 100 | 1.30 | 79 | 2.5 | 30.4 |
| 3 | 108.4 | 94 | 1.21 | 79 | 3.8 | 47.9 |
| 4 | 112.9 | 95 | 1.21 | 81 | 3.5 | 43.3 |

TABLE 1-continued

| EXAMPLE | FEED YARN BIREFRINGENCE X10³ | FEED YARN DECITEX | RATIO OF TENSIONING ROLL TO FEED ROLL SPEED | DECITEX OF YARN PRODUCED | EK (%) | KB (%) |
|---|---|---|---|---|---|---|
| Comparative B | 140 | 85 | 1.01 | 84 | 0.4 | 37.5 |

It is apparent from Table 1 that, as feed yarns of increasing birefringence are used, the values of initial crimp and mechanical crimp stability pass through a maximum.

EXAMPLES 5–9 AND COMPARATIVE EXAMPLES C, D AND E

A 230 decitex 44 filament drawable poly(ethylene terephthalate) yarn having a birefringence of $40\times10^{-3}$ was drawn and crimped by a process as shown diagrammatically in the accompanying drawing. The heated metal pin was circular having a diameter of 2.22 cm and a temperature of 170° C. The gear wheels are made of stainless steel and had 38 teeth per inch. The intermeshing of the gear wheels was such that the maximum overlap of teeth on the two gears was 0.356 mm.

The speed of the gear wheels was adjusted such that the yarn was drawn by the tension imparted to the yarn between the heated pin and the gear wheels. The surface speed of the tensioning roll was 840 meters per minute and the ratio of the surface speed of the tensioning roll to the surface speed of the feed roll was 1.53.

Eight gear-crimped yarns, each of decitex 150, were produced under controlled yarn tensions between the gear wheels and the tensioning roll of 0.13, 0.20, 0.23, 0.27, 0.30, 0.40, 0.53 and 0.60 g per decitex based on the decitex of the drawn yarn.

At the tension of 0.13 g/decitex the amount of bulk in the yarn was acceptable; however, the yarn was commercially unacceptable because some breaking of filaments in the yarn tended to occur during the gear crimping process.

The yarns so produced had initial crimp (EK) and mechanical crimp stability (KB) values as shown in Table 2.

TABLE 2

| EXAMPLE | YARN TENSION BETWEEN GEAR WHEELS AND TENSIONING ROLL (G/DTEX) | EK (%) | KB (%) |
|---|---|---|---|
| Comparative C | 0.13 | 1.8 | 31.2 |
| 5 | 0.20 | 2.3 | 37.8 |
| 6 | 0.23 | 2.8 | 47.0 |
| 7 | 0.27 | 2.6 | 36.0 |
| 8 | 0.30 | 2.6 | 40.0 |
| 9 | 0.40 | 2.2 | 21.9 |
| Comparative D | 0.53 | 1.5 | −35.9 |
| Comparative E | 0.60 | 1.2 | −68.2 |

It is apparent from Table 2 that, as increasing yarn tensions are used between the gear wheels and the tensioning roll, the values of initial crimp and mechanical crimp stability pass through a maximum.

EXAMPLE 10

A 115 decitex 22 filament drawable poly(ethylene terephthalate) yarn having a birefringence of $40\times10^{-3}$ and a trilobal filament cross-section was drawn and crimped by a process as shown diagrammatically in the accompanying drawing. The heated metal pin was circular having a diameter of 2.22 cm and a temperature of 150° C. The gear wheels were made of stainless steel and had 38 teeth per inch. The intermeshing of the gear wheels was such that the maximum overlap of teeth on the two gears was 0.356 mm.

The speed of the gear wheels was adjusted such that the yarn was drawn by the tension imparted to the yarn between the heated pin and the gear wheels. The surface speed of the tensioning roll was 543 meters per minute and the ratio of the surface speed of the tensioning roll to the surface speed of the feed roll was 1.53. The yarn tension between the gear wheels and the tensioning roll was controlled at 25 g, that is at 0.33 g/decitex based on the decitex of the drawn yarn.

A yarn tension of 25 g between the gear wheels and the tensioning roll was found to be the tension required to produce a crimped yarn having a maximum initial crimp value for the above process conditions.

The yarn so produced had a decitex of 76 and possessed latent bulk. The yarn had an initial crimp, measured as hereinbefore described, of 3.1% and a mechanical crimp stability of 43.7%. The yarn had a skein length value as great as 476 mm.

The latent bulk yarn was knitted into fabric. Bulk was fully developed in the knitted yarn during jet dyeing of the fabric at 130° C. The fabric was stabilised by post-setting at 170° C.

The fabric showed good bulk and had a desirable low glitter and low sheen. The fabric also had a full and silk-like handle.

COMPARATIVE EXAMPLE F

A crimped yarn was made as in Example 10 except that the yarn tension between the gear wheels and the tensioning roll was controlled at 68 g, that is at 0.89 g per decitex based on the decitex of the drawn yarn. A yarn tension of 68 g was found to be the tension required to produce a crimped yarn having an optimum skein length test value. The skein length test value measured under a load of 20 g in water at 60° C. was 463 mm.

The latent bulk yarn had a decitex of 76, an initial crimp of 1.37% and a mechanical crimp stability of −15.3%.

Fabric was knitted from the yarn. It was found to be essential to heat set the fabric prior to dyeing and finishing. The finished fabric was leaner, shinier and had a less full handle compared with the fabric in Example 10.

EXAMPLE 11

A crimped yarn was made as in Example 10 except that the heated metal pin had a temperature of 180° C. A yarn tension of 25 g between the gear wheels and the tensioning roll was again found to be the tension required to produce a crimped yarn having a maximum initial crimp value.

The yarn so produced had a decitex of 76, an initial crimp of 4.4%, and a mechanical crimp stability of 48.1%. The yarn had a skein length test value as great as 476 mm.

Fabric, knitted from the yarn and dyed as in Example 10, showed similar properties to the fabric of Example 10.

COMPARATIVE EXAMPLE G

A crimped yarn was made as in Example 11 except that the yarn tension between the gear wheels and the tensioning roll was controlled at 68 g, that is at 0.89 g per decitex based on the decitex of the drawn yarn. A yarn tension of 68 g was found to be the tension required to produce a crimped yarn having an optimum skein length test value. The skein length test value measured under a load of 20 g in water at 60° C. was 468 mm.

The latent bulk yarn had a decitex of 76, an initial crimp of 1.82% and a mechanical crimp stability of −2.5%.

Fabric was knitted from the yarn. It was found essential to heat set the fabric prior to dyeing and finishing. The finished fabric had similar properties to the fabric of Comparative Example F.

EXAMPLES 12–14

A 115 decitex 22 filament drawable poly(ethylene terephthalate) yarn having a birefringence of $43.2\times10^{-3}$ and a trilobal filament cross-section was simultaneously drawn and crimped by a process as shown diagrammatically in the accompanying drawing. The heated metal pin was circular and had a diameter of 2.22 cm. The gear wheels were made of stainless steel and had 38 teeth per inch. The intermeshing of the gear wheels was such that the maximum overlap of teeth on the two gears was 0.356 mm.

The speed of the gear wheels was adjusted such that the yarn was drawn by the tension imparted to the yarn between the heated pin and the gear wheels. The surface speed of the tensioning roll was 840 meters per minute and the ratio of the surface speed of the tensioning roll to the surface speed of the feed roll was 1.58. The yarn tension between the gear wheels and the tensioning roll was controlled at 20 g, that is at 0.27 g/decitex based on the decitex of the drawn yarn.

Three gear-crimped yarns, each of decitex 73, were produced using heated metal pin temperatures of 170° C., 160° and 150° C.

The yarn so produced had initial crimp (EK) and mechanical crimp stability (KB) values as shown in Table 3.

TABLE 3

| EXAMPLE | PIN TEMPERATURE | EK (%) | KB (%) |
|---|---|---|---|
| 12 | 170° C. | 2.1 | 59.4 |
| 13 | 160° C. | 2.0 | 43.7 |
| 14 | 150° C. | 1.6 | 26.3 |

It is apparent from Table 3 that, as the heated pin temperature is decreased from 170° C. to 150° C., the values of initial crimp and mechanical crimp stability decrease. The yarn produced using a pin temperature of 150° C. showed a level of bulk, after development of the bulk in knitted fabric, which was just acceptable.

We claim:

1. A drawn gear-crimped polyester yarn with latent bulk characterised by an initial crimp as defined of at least 1.5% and a mechanical crimp stability as defined of above 0%.

2. A drawn gear-crimped polyester yarn with latent bulk characterised by an initial crimp as defined of above 2% and a mechanical crimp stability as defined of above 0%.

3. A crimped yarn according to claim 2 having an initial crimp of above 3% and a mechanical crimp stability of above 35%.

4. A crimped yarn according to claim 1 in which the filaments of the yarn have a non-circular cross-section.

5. A crimped yarn according to claim 1 in which the polyester is poly(ethylene terephthalate).

6. A crimped yarn according to claim 1 in which the bulk has been developed.

7. A fabric containing a crimped yarn according to claim 1.

* * * * *